US010058158B2

(12) United States Patent
Chan

(10) Patent No.: US 10,058,158 B2
(45) Date of Patent: Aug. 28, 2018

(54) HAIR WAVING APPARATUS

(71) Applicant: Conair Corporation, Stamford, CT (US)

(72) Inventor: Hon Hung Joseph Chan, Hong Kong (CN)

(73) Assignee: CONAIR CORPORATION, Stamford, CT (US)

( * ) Notice: Subject to any disclaimer, the term of this patent is extended or adjusted under 35 U.S.C. 154(b) by 412 days.

(21) Appl. No.: 14/935,045

(22) Filed: Nov. 6, 2015

(65) Prior Publication Data

US 2017/0127785 A1 May 11, 2017

(51) Int. Cl.
*A45D 2/02* (2006.01)
*A45D 1/10* (2006.01)
*A45D 2/00* (2006.01)

(52) U.S. Cl.
CPC ..... *A45D 2/02* (2013.01); *A45D 1/10* (2013.01); *A45D 2002/006* (2013.01)

(58) Field of Classification Search
CPC ... A45D 2/02; A45D 2/12; A45D 2/36; A45D 2/367; A45D 1/10; A45D 2002/006
USPC ..... 132/224, 238, 237
See application file for complete search history.

(56) References Cited

U.S. PATENT DOCUMENTS 2,062,561 A * 12/1936 De Lado ..... A45D 2/001 132/269
5,119,847 A * 6/1992 Powell ..... A45D 2/00 132/210
5,671,759 A 9/1997 Chung et al.
5,765,572 A 6/1998 Paget et al.
5,799,671 A * 9/1998 Takimae ..... A45D 2/002 132/118
6,070,596 A * 6/2000 Altamore ..... A45D 1/04 132/224
6,109,275 A 8/2000 Mendezmonsanto
6,318,378 B1 11/2001 Kennedy et al.
6,499,491 B2 12/2002 Kennedy et al.
6,615,846 B1 9/2003 Leason et al.
6,637,441 B2 10/2003 Kennedy et al.
6,662,808 B2 12/2003 Leason et al.
6,682,776 B2 1/2004 Araki et al.
D491,310 S 6/2004 Glucksman et al.
D502,288 S 2/2005 Longoria
7,271,368 B2 9/2007 Yeung
7,341,064 B2 3/2008 Habibi
7,481,228 B2 1/2009 Ragosta et al.
7,631,646 B2 12/2009 Ragosta et al.
RE41,321 E 5/2010 Okumoto et al.
(Continued)

*Primary Examiner* — Tatiana Nobrega
(74) *Attorney, Agent, or Firm* — Lawrence Cruz, Esq.; Joseph W. Schmidt, P.C.

(57) ABSTRACT

A hair waving apparatus includes a handle component defining a longitudinal axis, and proximal and distal ends and a rotatable component operatively coupled to the handle component and adapted for rotatable movement about the longitudinal axis to engage a length of hair to impart a waving effect to the length of hair. The rotatable component includes a first treatment member and a second treatment member configured for relative movement between an open condition and an approximated condition. At least one of the first and second treatment members includes a heating element. A drive is operatively coupled to the rotatable component to impart rotational movement to the rotatable component.

20 Claims, 10 Drawing Sheets

(56) References Cited

U.S. PATENT DOCUMENTS

| | | | | |
|---|---|---|---|---|
| 8,013,274 | B2 | 9/2011 | Suzuki et al. | |
| 8,232,505 | B2 | 7/2012 | Hottenrott et al. | |
| 8,237,089 | B2 | 8/2012 | Legrain et al. | |
| 8,342,191 | B2 | 1/2013 | Ragosta et al. | |
| 8,360,076 | B2 | 1/2013 | Ragosta et al. | |
| 8,539,964 | B2 | 9/2013 | Rong | |
| 8,539,965 | B2 | 9/2013 | Ragosta et al. | |
| 8,541,715 | B2 | 9/2013 | Overend et al. | |
| 8,567,416 | B2 | 10/2013 | Ragosta et al. | |
| D696,456 | S | 12/2013 | Julemont | |
| 8,607,804 | B2 | 12/2013 | De Benedictis | |
| 8,651,118 | B2 | 2/2014 | De Benedictis et al. | |
| 8,733,374 | B2 | 5/2014 | De Benedictis et al. | |
| 8,869,808 | B2 | 10/2014 | De Benedictis | |
| D717,000 | S | 11/2014 | Julemont | |
| 8,955,526 | B2 | 2/2015 | Smith | |
| D724,784 | S | 3/2015 | Richmond et al. | |
| 9,027,570 | B2 | 5/2015 | De Benedictis et al. | |
| D732,738 | S | 6/2015 | Richmond et al. | |
| 9,060,582 | B2 | 6/2015 | Longoria et al. | |
| D735,410 | S | 7/2015 | Richmond et al. | |
| 2004/0237991 | A1 | 12/2004 | Glucksman et al. | |
| 2005/0061352 | A1* | 3/2005 | Yao | A45D 1/04 132/225 |
| 2011/0226278 | A1* | 9/2011 | Rivola | A45D 1/06 132/232 |
| 2012/0111357 | A1* | 5/2012 | Amkie | A45D 1/04 132/230 |
| 2012/0325262 | A1 | 12/2012 | Sansole et al. | |
| 2013/0199561 | A1* | 8/2013 | Schlough | A45D 1/16 132/211 |
| 2013/0240498 | A1* | 9/2013 | Tang | A45D 1/04 219/225 |
| 2013/0306099 | A1* | 11/2013 | Lam | A45D 1/04 132/211 |
| 2013/0319450 | A1 | 12/2013 | Ragosta et al. | |
| 2014/0238432 | A1 | 8/2014 | Deng | |
| 2015/0000689 | A1 | 1/2015 | De Benedictis | |
| 2015/0114425 | A1 | 4/2015 | Park | |
| 2015/0128985 | A1 | 5/2015 | Lee | |
| 2015/0128987 | A1 | 5/2015 | De Benedictis et al. | |
| 2016/0058151 | A1* | 3/2016 | Palotai | A45D 1/04 132/211 |

* cited by examiner

Release the thumb and let the styler close

Press the Thumb-press to open the styler then put a swatch of hair into the opening of styler Small Hair Strand Medium Hair Strand Large Hair Strand

HAIR WAVING APPARATUS

TECHNICAL FIELD

The present disclosure is directed to a hairstyling apparatus, and, more particularly, to a hair waving apparatus for imparting waves, curls or twists within lengths of hair.

BACKGROUND

Hair styling devices for styling or waving hair are known in the art. For example, U.S. Pat. Nos. 8,607,804, 8,651,118, 8,733,374 and 8,869,808 and U.S. Design Pat. No. D696, 456, each of these patents being incorporated herein by reference in its respective entirety, disclose a hair styling device which includes a rotatable component for wrapping hair about a guide member to produce at least one curl in the length of hair.

SUMMARY

Accordingly, the present disclosure is directed to a hair waving apparatus for imparting a multitude of wave styles in a subject's hair. The hair waving apparatus includes a handle component defining a longitudinal axis, and proximal and distal ends, and a rotatable component operatively coupled to the handle component and adapted for rotatable movement about the longitudinal axis to engage a length of hair to impart a waving effect to the length of hair. The rotatable component includes a first treatment member and a second treatment member configured for relative movement between an open condition and an approximated condition. At least one of the first and second treatment members includes a heating element. A drive is operatively coupled to the rotatable component to impart rotational movement to the rotatable component.

The hair waving apparatus may include a primary comb mounted to the first treatment member in transverse relation to the longitudinal axis. The heating element may be mounted to the first treatment member adjacent the primary comb. The second treatment member may define a recess for at least partial reception of the primary comb when in the approximated condition of the rotatable component. An entry comb may be mounted to the first treatment member proximal of the primary comb. In an embodiment, an entry comb may be mounted to the second treatment member whereby at least some of the teeth of the entry combs of the first and second treatment members interdigitate when the rotatable component is in the approximated condition.

The hair waving apparatus may include left and right hair guides depending from the first treatment member on opposed left and right sides of the primary comb. The hair guides are dimensioned to capture the hair within the rotatable component. The second treatment member may include left and right recesses for respectively at least partially receiving the left and right hair guides.

The rotatable component may be configured and adapted for rotational movement in first and second rotational directions relative to the longitudinal axis. The drive member may include a motor disposed within the handle component and operatively coupled to the rotatable component. A manually operable rotation actuator may be disposed on the handle component and in electrical communication with the motor. The rotation actuator may be movable between at least first and second positions corresponding to the first and second rotational directions of the rotatable component.

The first and second treatment members may be configured and adapted for pivotal movement between the open condition and the approximated condition.

The wave styling apparatus of the present disclosure is adapted to provide a variety of hair waving, twisting, and curling etc. effects on the subject's hair. The apparatus may accommodate swatches of hair of varying thickness and length and may be utilized to provide tight or loose curls as well as curls extending in relative reverse direction on the subject's head. The arrangement of the primary and entrance combs coupled with the hair guides enhances hair capture within the apparatus which facilitates the waving process during rotation of the rotatable component. Other aspects, features and advantages will be apparent from the description, drawings and the claims.

BRIEF DESCRIPTION OF THE DRAWINGS

Embodiments of the present disclosure will be readily appreciated by reference to the drawings wherein.

DETAILED DESCRIPTION

Figure 1A:
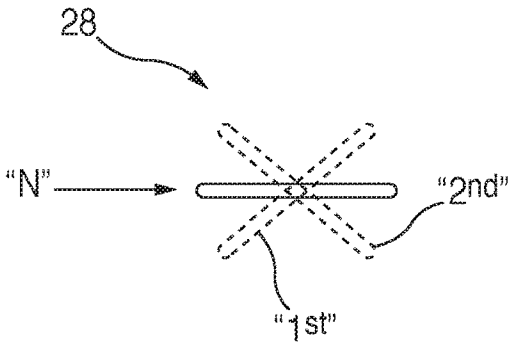
FIG. 1A schematically illustrates three operating positions of the rotation actuator for controlling the rotatable component.

Referring initially to FIGS. 1-5, the hair waving apparatus 10 in accordance with the principles of the present disclosure is illustrated. The hair waving apparatus 10 is particularly adapted to apply a waving effect or treatment on the hair and may be utilized to provide various types of hair waves on a multiple number of hair strands, and produce different wave effects. In the description that follows, the term "waving" or "wave" is to be interpreted to at least include a wave, twist, curl or turn imparted to one or more strands of hair or to a length of hair.

The apparatus 10 includes a handle component 12 defining a longitudinal axis "k" and a rotatable hair treatment component 14 coupled to the handle component 12. The handle component 12 may include upper and lower (or left and right) handle frame sections 16, 18 secured to each other via conventional means including screws, adhesives of the like. The handle component 12 defines proximal and distal ends 20, 22 with the rotatable component 14 being disposed adjacent the distal end 22. An electric cord 24 is secured adjacent the proximal end 20 of the handle component 12. The electric cord 24 may have a conventional plug (not shown) to engage a power source such as a wall outlet to provide electrical energy to operate the appliance. In the alternative, or optionally, the apparatus 1 may be battery operated. The battery may be rechargeable.

Figure 1:
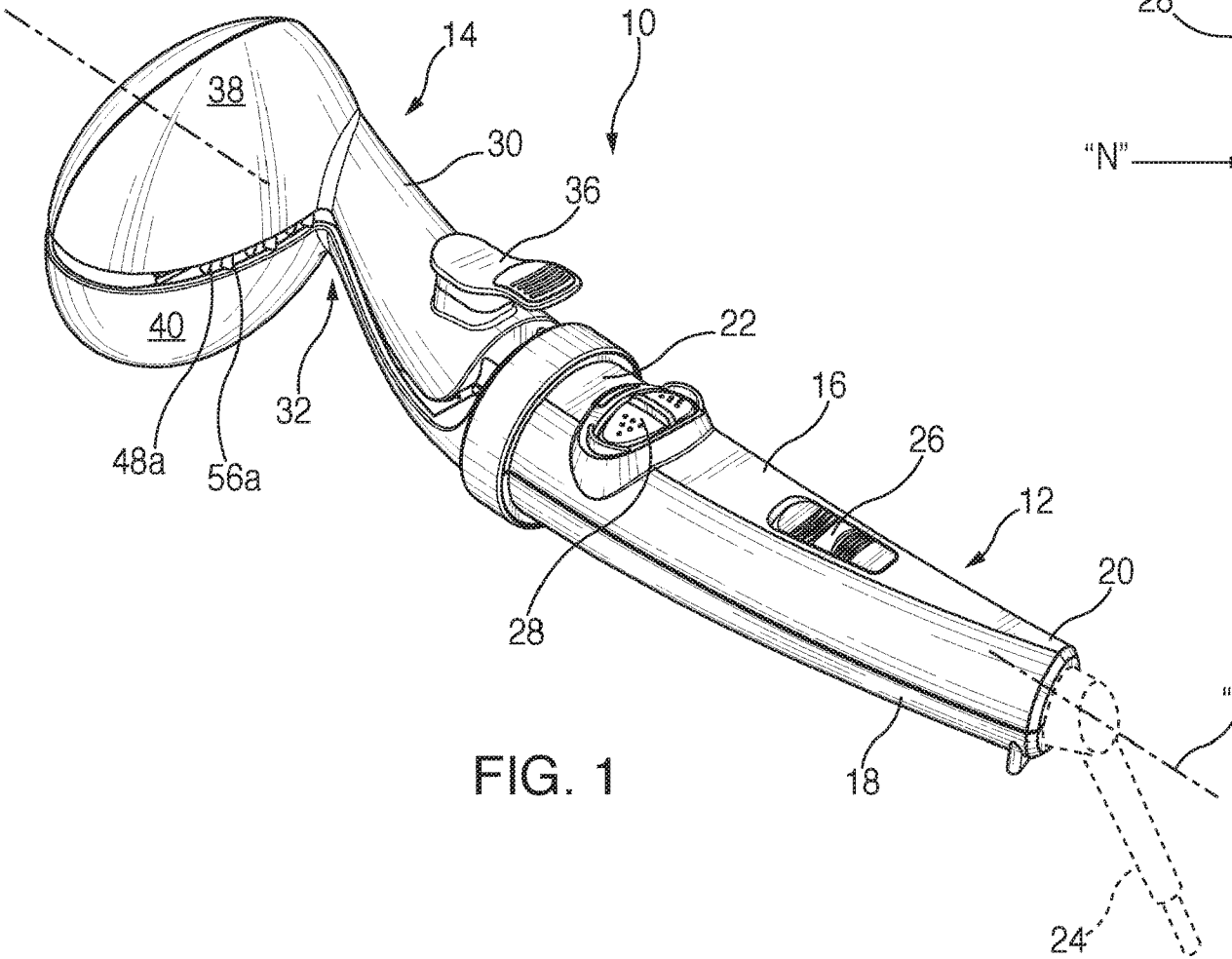
FIG. 1 is a perspective view of the hair waving apparatus in accordance with the principles of the present disclosure illustrating the handle component and the rotatable component with the first and second treatment members of the rotatable component in an approximated condition.

The handle component 12 further includes a power actuator 26 which may be slidably mounted to one of the frame sections 16, 18 for activating the apparatus 10 and a rotation actuator 28 for initiating rotation of the rotatable component 14 about the longitudinal axis "k". The rotation actuator 28 may be actuable through at least three positions including a neutral position "n" corresponding to a stationary condition of the rotatable component 14, a first position "$1^{st}$" corresponding to rotational movement of the rotatable component 14 in a first rotational direction about the longitudinal axis "k", and a second position "$2^{nd}$" corresponding to rotational movement of the rotatable component 14 in a second or opposite rotational direction about the longitudinal axis "k". FIG. 1 illustrates the neutral position of the rotation actuator 28. FIG. 1A schematically illustrates the neutral "n" and first and second positions "$1^{st}$", "$2^{nd}$" the rotation actuator 28.

Figure 6:
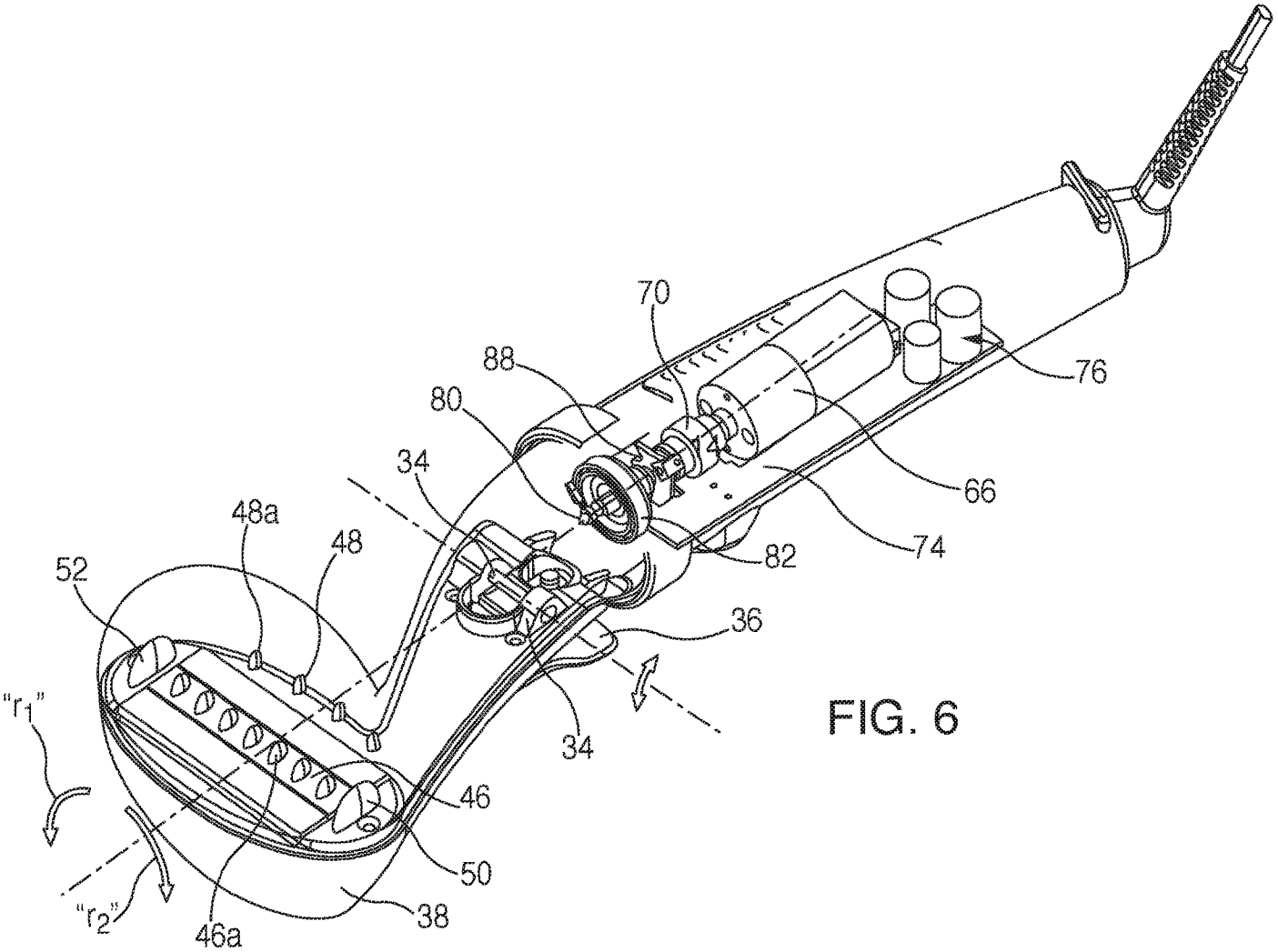
FIG. 6 is a perspective view with portions of the handle component and the second treatment member removed illustrating operating components of the hair waving apparatus.

Referring now to FIGS. 1-6, the rotatable component 14 further includes first and second hair treatment members 30, 32 mounted for movement relative to each other. In one embodiment, the first treatment member 30 is pivotally mounted to the second treatment member 32 about a hinge 34 (FIG. 6), and is adapted to pivot between the approximated condition of FIGS. 1, 4 and 5 and the open condition of FIGS. 2-3. In FIG. 6, the second treatment member 32 is shown removed for illustrative purposes. Other methodologies for pivotally mounting the first treatment member 30 to the second treatment member 32 may be appreciated by one skilled in the art. A manually operable pivot member 36 is secured to the exterior of the first treatment member 30 to permit the operator to selectively move the first treatment member 30 about the hinge 34 between the open and approximated conditions.

Figure 2:
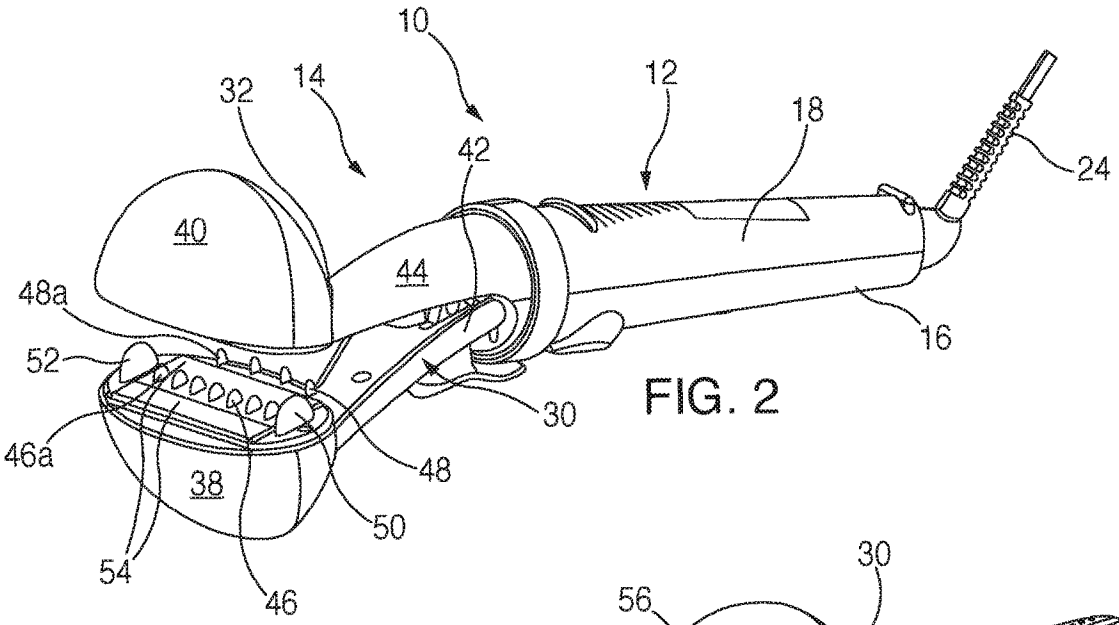
FIGS. 2-3 are perspective views of the hair waving apparatus with the first and second treatment members of the rotatable component in an open condition.
Figure 3:
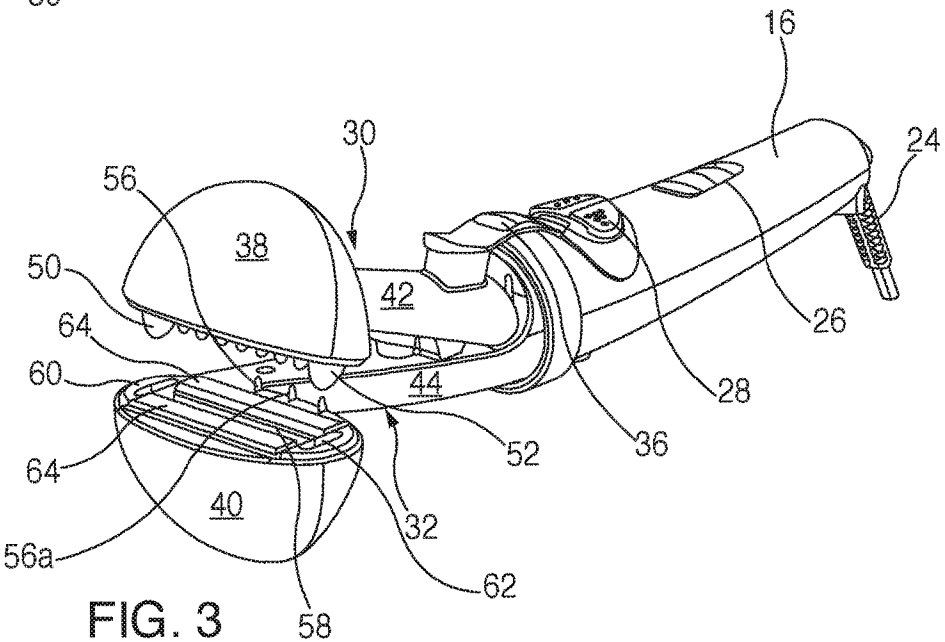
Figure 4:
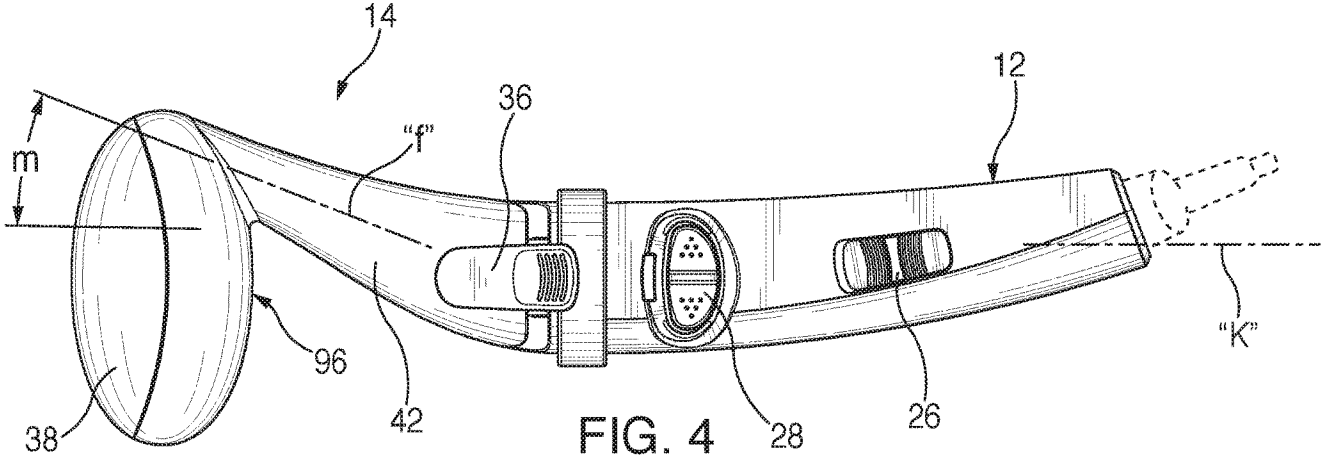
FIGS. 4-5 are left and right side elevation views of the hair waving apparatus with the first and second treatment members of the rotatable component in the approximated condition.
Figure 5:
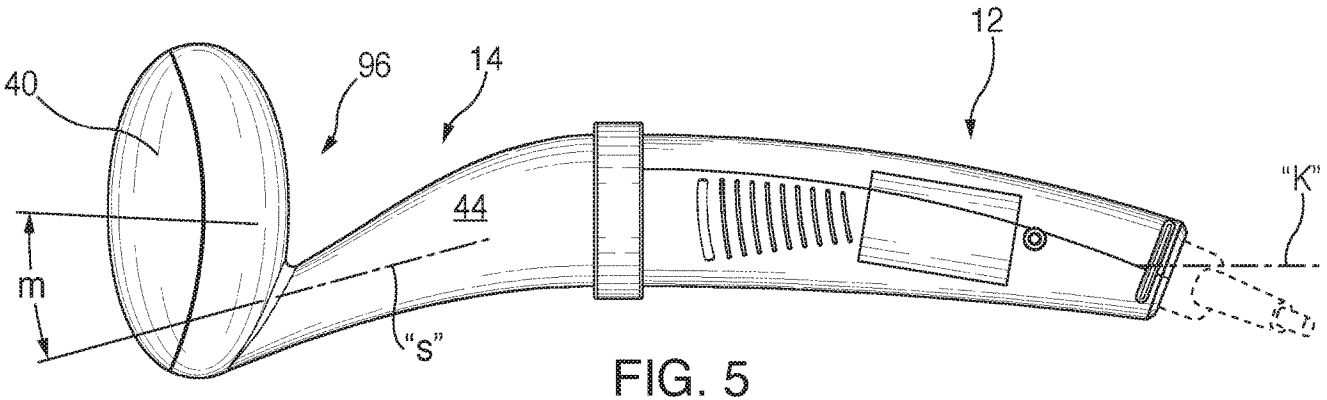

As best depicted in FIGS. 2-3, the first and second treatment members 30, 32 include respective first and second treatment heads 38, 40 and first and second connecting segments 42, 44 which depend from the respective first and second treatment heads 38, 40 toward handle component 12. The first and second treatment heads 38, 40 each may define a portion of a sphere although other shapes are contemplated. The first treatment head 38 includes a primary comb 46 having comb teeth 46*a* extending in general transverse relation to the longitudinal axis "k" and an entry comb 48 having comb teeth 48*a* proximal of the primary comb 46. The first treatment head 38 further includes left and right hair guides 50, 52 depending upwardly toward the second treatment head 40. The first treatment head 38 has at least one heating plate 54 which may extend along one or both sides (e.g., proximal and distal) of the primary comb 46. In the alternative, two separate heating plates 54 may be provided. The heating plate 54 may be formed of thermally conductive materials such as aluminum, steel, ceramic or other materials. A heat source may be incorporated within the heating plate 54 or in communication therewith. The second treatment head 40 includes an entry comb 56 having teeth 56*a* which are positioned to interdigitate with the teeth 46*a* of the primary comb 46 of the first treatment head 38 when in the approximated condition of the rotatable component 14. (See FIG. 1). The second treatment head 40 defines a slot 58 extending generally transverse relative to the longitudinal axis "k" and left and right recesses 60, 62. The slot 58 and the left and right recesses 60, 62 are dimensioned to at least partially respectively receive the primary comb 46 and the left and right hair guides 50, 52 of the first treatment head 38 when in the approximated condition of the rotatable component 14. These features reduce the profile of the rotatable component 14 and also enhances capture and combing of the hair within the rotatable component 14. A heating plate 64 also may be positioned on at least one or both sides (proximal and distal) of the slot 58. The heating plate 64 may be similar to the heating plate 54 of the first treatment head 38.

With reference to FIGS. 6-9, details of the drive mechanism will be discussed. The handle component 12 includes a motor/gear box 66 which drives a keyed drive rod or axle 68, an internally keyed bushing 70 and a swivel power connector 72. A control circuit, e.g., inclusive of a circuit board 74, may be provided and includes components or logic 76 to control operation of the apparatus 10. The circuit board 74 is in electrical communication with the power and rotation actuators 26, 28, the heat source or heating plates 54, 64 and the motor/gear box 66.

The rotatable component 14 is coupled to a keyed drive shaft 78. The drive axle 68 and the drive shaft 78 are received within respective ends of the keyed bushing 70 such that rotational movement of the drive axle 68 via activation of the motor/gear box 66 causes corresponding rotation of the drive shaft 78 thereby effecting rotation of the rotatable component 14 about the longitudinal axis "k" in both first and second rotational directions "r1", "r2" (FIG. 6). In one embodiment, the rotatable component 14 is secured to the drive shaft 78 with a fastener or screw 80 which extends through the frame of the second treatment member 32. Additionally, or alternatively, the drive shaft 78 may be fixed relative to collar 82, which is, in turn, secured to the rotatable component 14.

Figure 7:
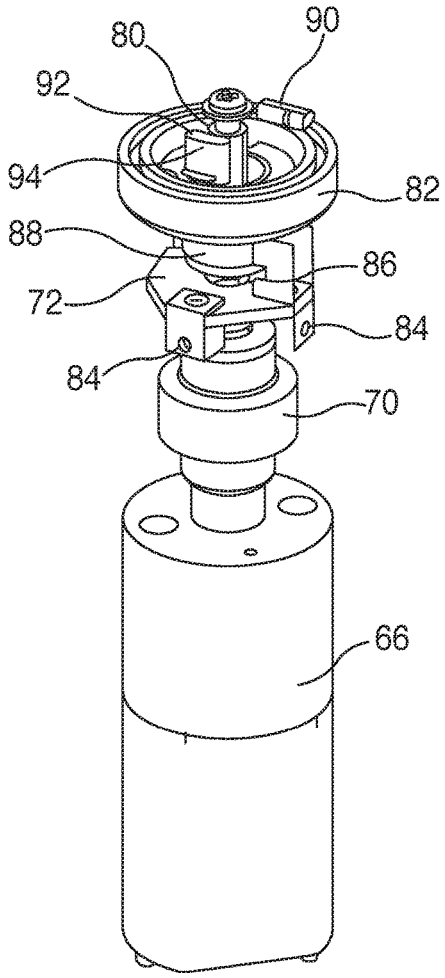
FIG. 7 is a perspective view of the rotatable drive mechanism of the hair waving apparatus.
Figure 8:
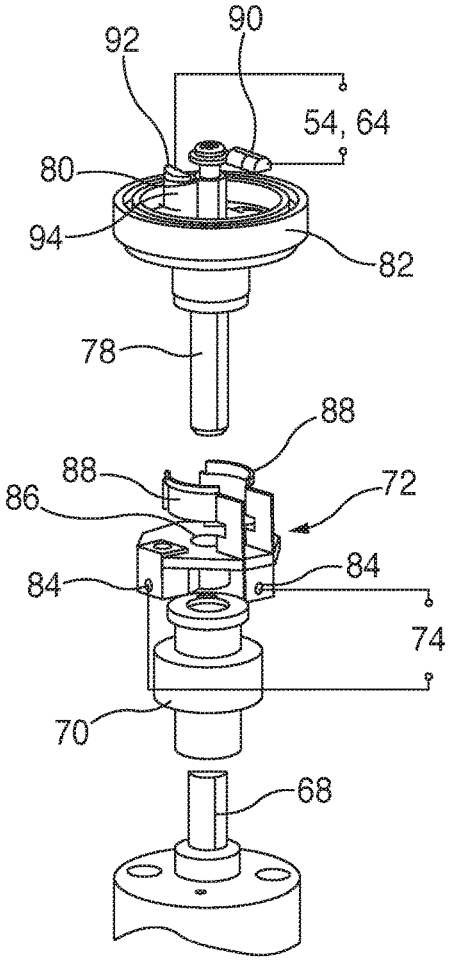
FIG. 8 is an exploded perspective view of the rotatable drive mechanism.
Figure 9:
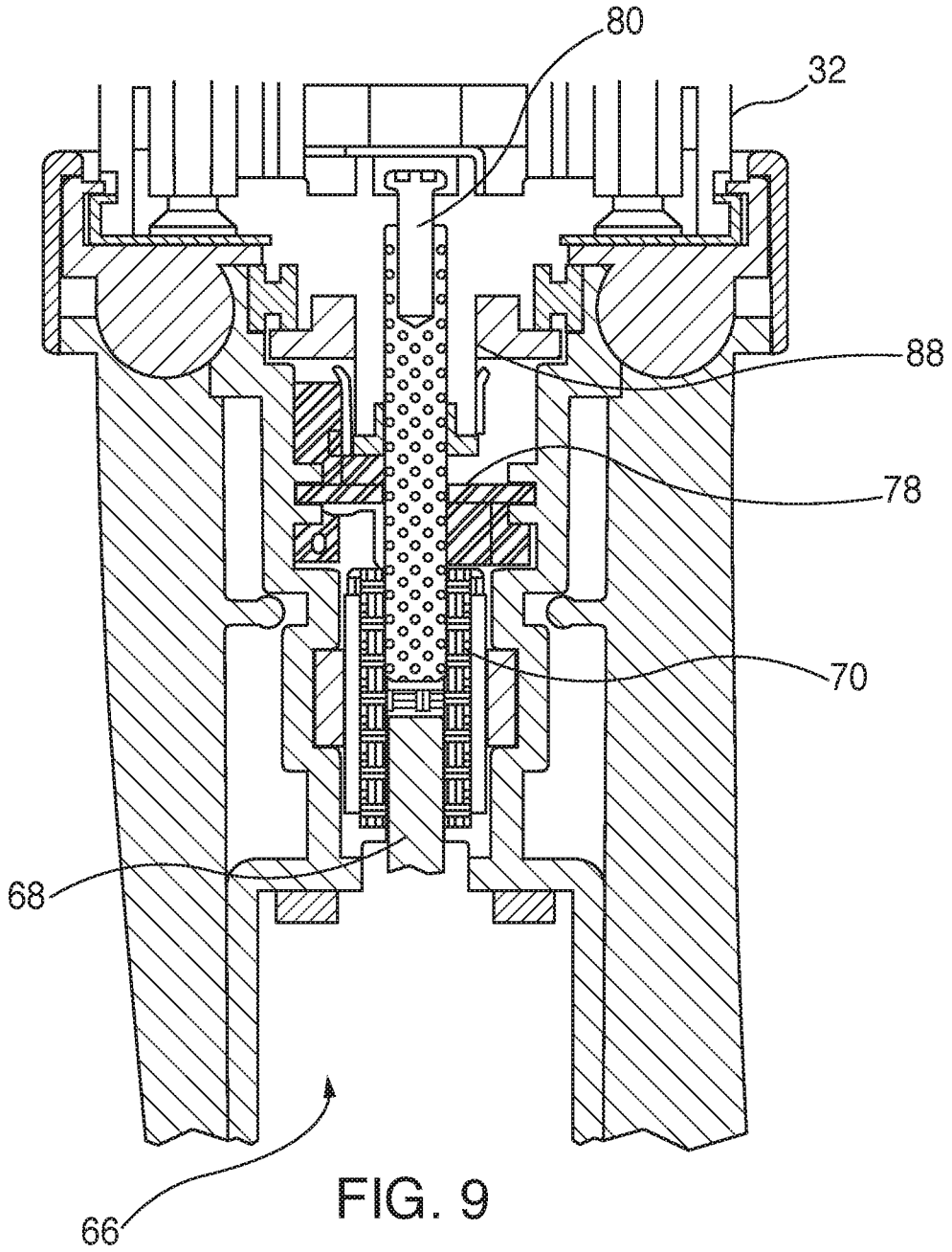
FIG. 9 is a side cross-sectional view of the rotatable drive mechanism.

As best depicted in FIGS. 7-9, the swivel power connector 72 delivers electric power to the heating plates 54, 64 and/or heat sources and includes electrical connectors 84 which are in communication with the circuit board 74. The swivel power connector 72 defines a central aperture 86 which receives the drive shaft 78 of the rotatable component 14, and may rotate with the drive axle 68 and the drive shaft 78. In one embodiment, the central aperture 86 is keyed to correspond to the keyed arrangement of the drive shaft 78. The swivel power connector 72 includes two upwardly extending and partially semicircular electrical contacts 88 in electrical communication with the electrical connectors 84.

The drive mechanism further includes one or more electrical contacts or connectors 90, 92 extending within the interior of the collar 82. The electrical connector 90 may be mounted to the fastener or screw 80 and the electrical connector 92 may be mounted to connector mount 94. The electrical connectors 90, 92 deliver power to the heating plates 54, 64 and are electrically coupled to the semicircular electrical contacts 88 of the swivel power connector 72. The electrical connectors 90, 92 may also rotate with the drive shaft 78 and the swivel power connector 72. One skilled in the art may envision other alternative methodologies electrically couple the swivel power connector 72 with the heating plates 54, 64.

Referring again to FIGS. 4-5, further details of the first and second treatment members 30, 32 will be discussed. As depicted, the first and second connecting segments 42, 44 are arranged about respective axes "f", "s" each extending at an angle "m" in oblique relation with respect to the longitudinal axis "k", and arc connected to the sides of the respective first and second treatment heads 38, 40. The angle "m" may range from between about 10 degrees and about 60 degrees, and in one embodiment, is about 45 degrees. This arrangement provides an ingress or avenue 96 for the strands of hair to enter between the first and second treatment heads 38, 40 generally in a direction along the longitudinal axis "k". This facilitates manipulation of the apparatus 10 by the operator as will be appreciated from the discussion hereinbelow.

Figure 11:
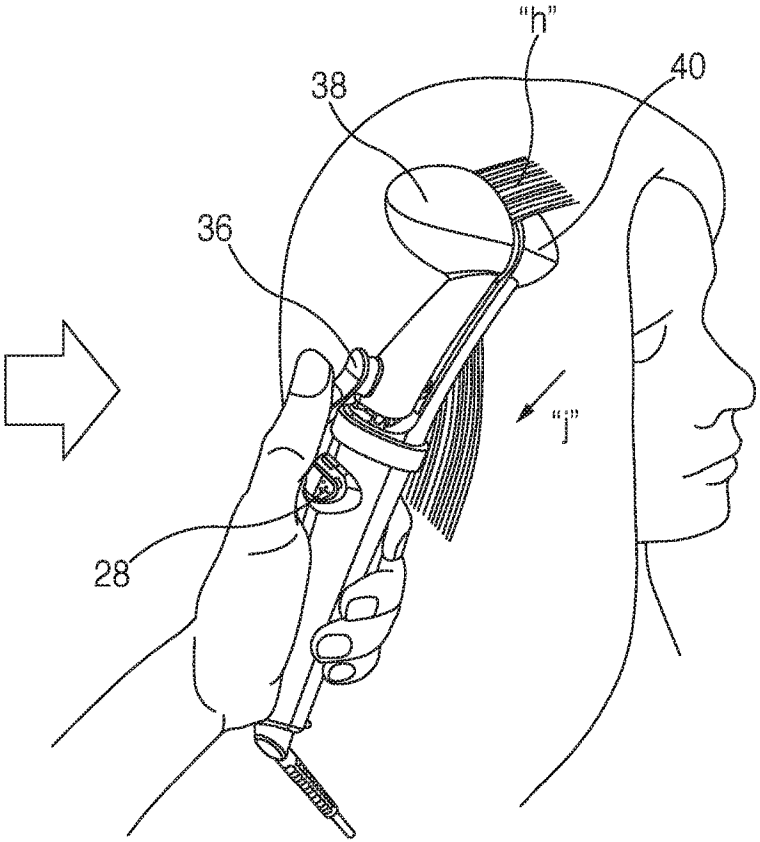
FIGS. 10-14 are views illustrating use of the hair waving apparatus in imparting waves to a length of hair.
Figure 10:
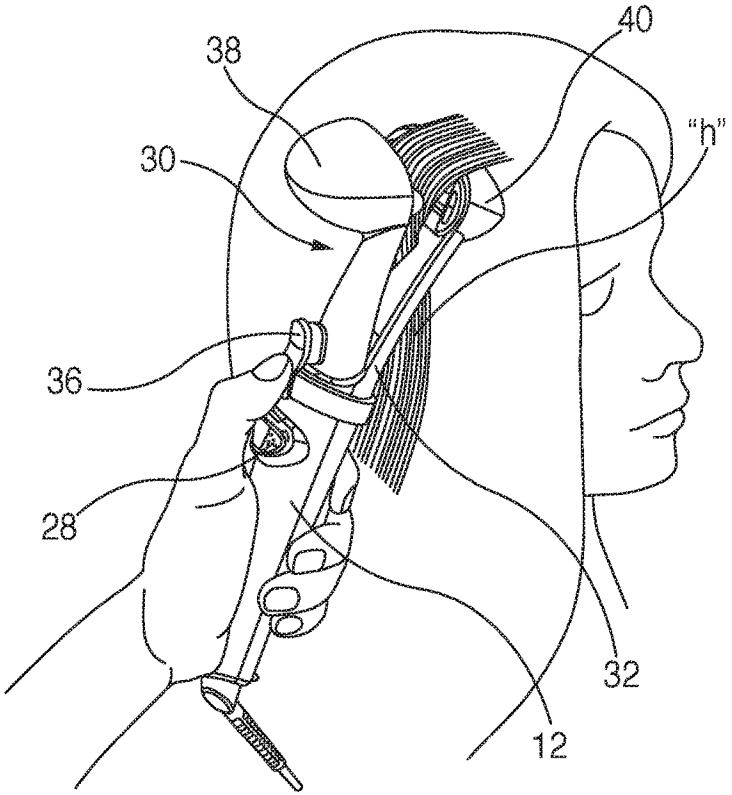
Figure 12:
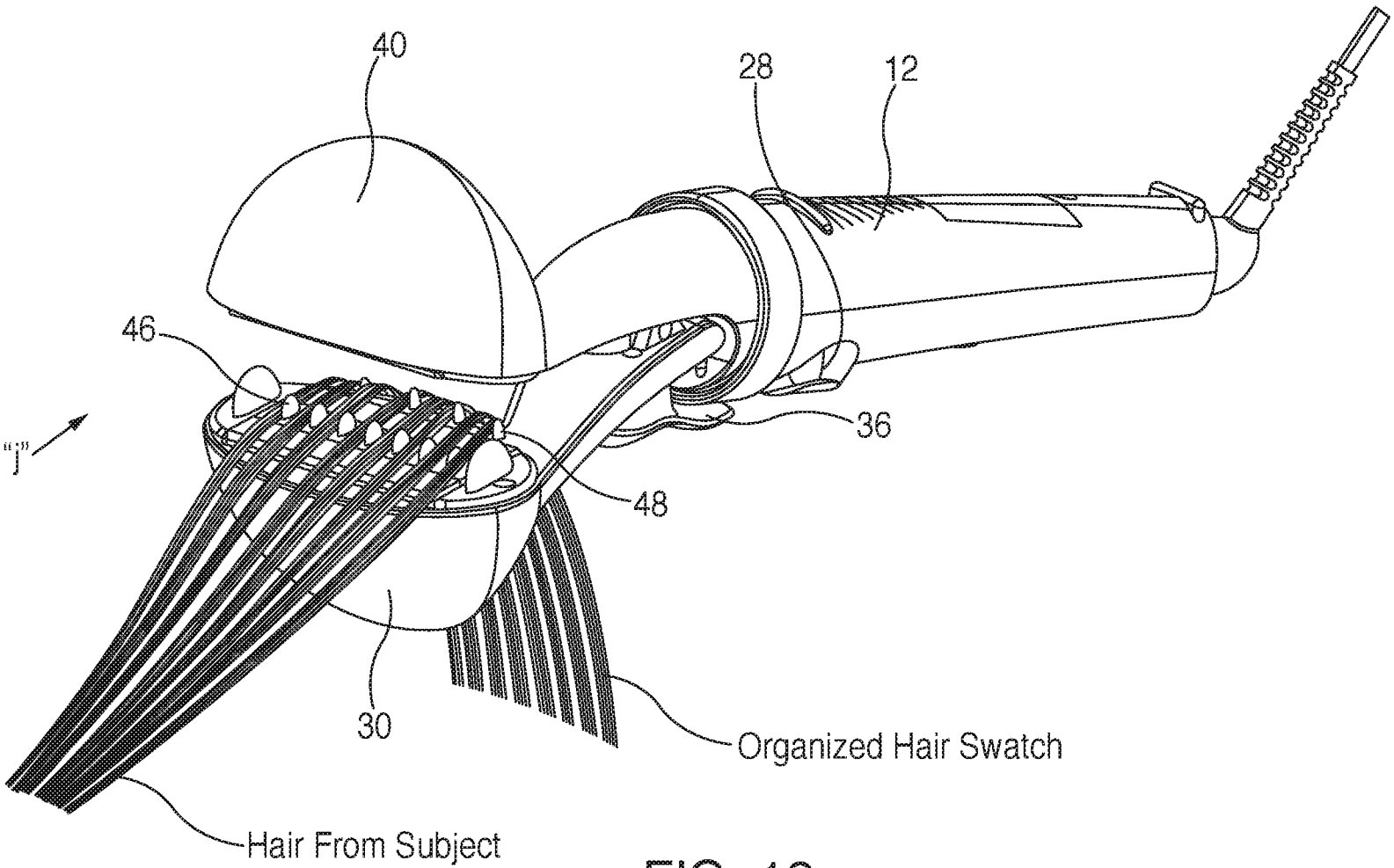

The use of the hair waving apparatus 10 for imparting a twist, curl or wave in a length or swatch of hair will be discussed. With reference to FIG. 10, the first treatment member 30 of the rotatable component 14 is pivoted to the open condition by depression of the manually operable pivot member 36 and a swatch or length of hair "h" is introduced through the open treatment heads 38, 40. The manually operable pivot member 36 may be released to move the first treatment member 30 to the approximated condition of FIG. 11. The heating plates 54, 64 are activated by depression of the power actuator 26. The apparatus 10 is pulled in a direction downward or away from the subject's head "j" whereby the entry combs 48, 56 of the first and second treatment heads 38, 40 and the primary comb 46 of the first treatment head 38 impart a combing effect on and organize the length of hair "h" as depicted in FIG. 12. In FIG. 12, the first treatment member 30 is shown in the open condition for illustrative purposes. The interdigitating arrangement of the teeth 48*a*, 56*a* of the entry combs 48, 56 (FIG. 1) facilitate the initial combing process.

Figure 14:
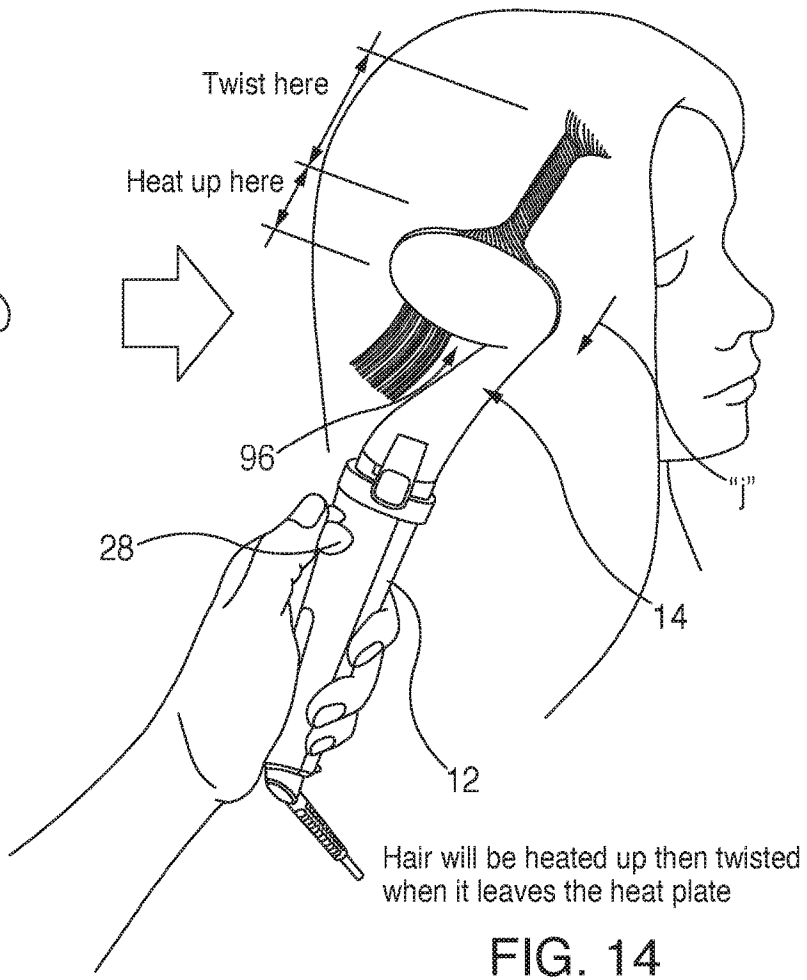
Figure 13:
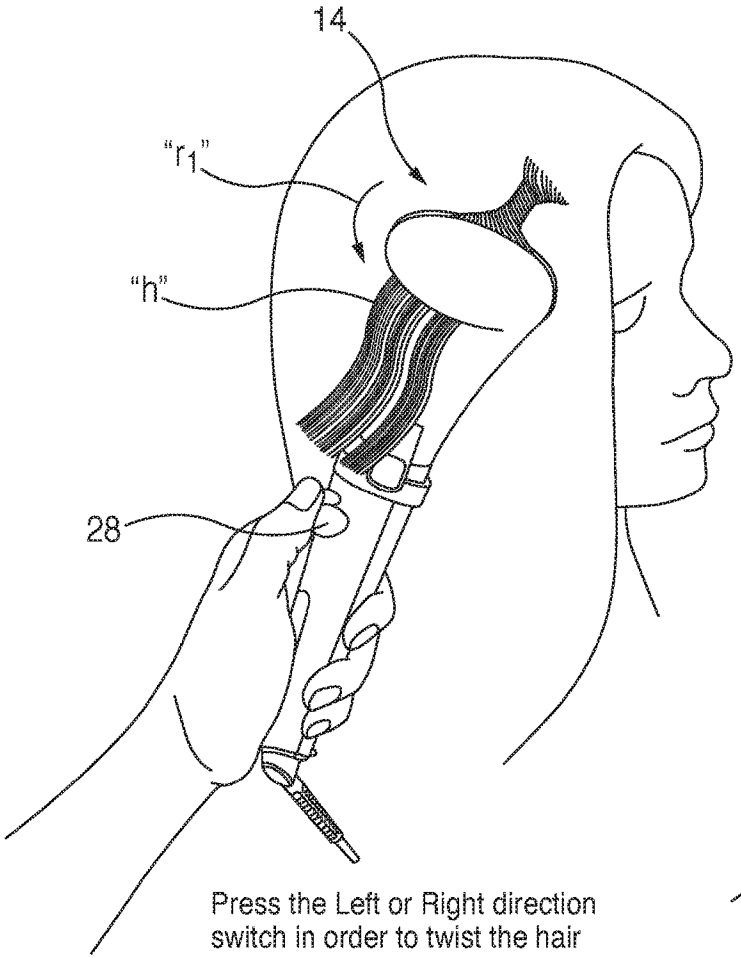

With reference to FIGS. 13-14, the waving process is begun by activating the rotation actuator 28. As discussed hereinabove, the rotation actuator 28 may be depressed to assume the first or second position "1$^{st}$", "2$^{nd}$" (FIG. 1A) to impart rotational movement of the rotatable component 14 in a selected first or second rotational direction "r1", "r2" about the longitudinal axis "k". The length of hair "h" is heated between the heating plates 54, 64 and twisted via rotation of the rotatable component 14. The apparatus 10 is pulled in the downward direction away from the head (direction "j") with the length of hair "h" entering through the entry combs 48, 56 along ingress 96 while the treatment heads 38, 40 remain in the approximated condition. The hair "h" is captured between the left and right hair guides 50, 52 of the first treatment head 38, combed and twisted. As discussed hereinabove, the oblique arrangement of the first and second connecting segments 42, 44 of the first and second treatment members 30, 32 defining the ingress 96 permits the operator to directly pull the apparatus 10 downward or outward from the head while the hair "h" is fed between the treatment heads 38, 40 in general longitudinal alignment with the longitudinal axis "k". This minimizes awkward maneuvering of the apparatus 10 thereby potentially reducing operator fatigue while also facilitating the treatment process.

Figures 15, 16, 17:
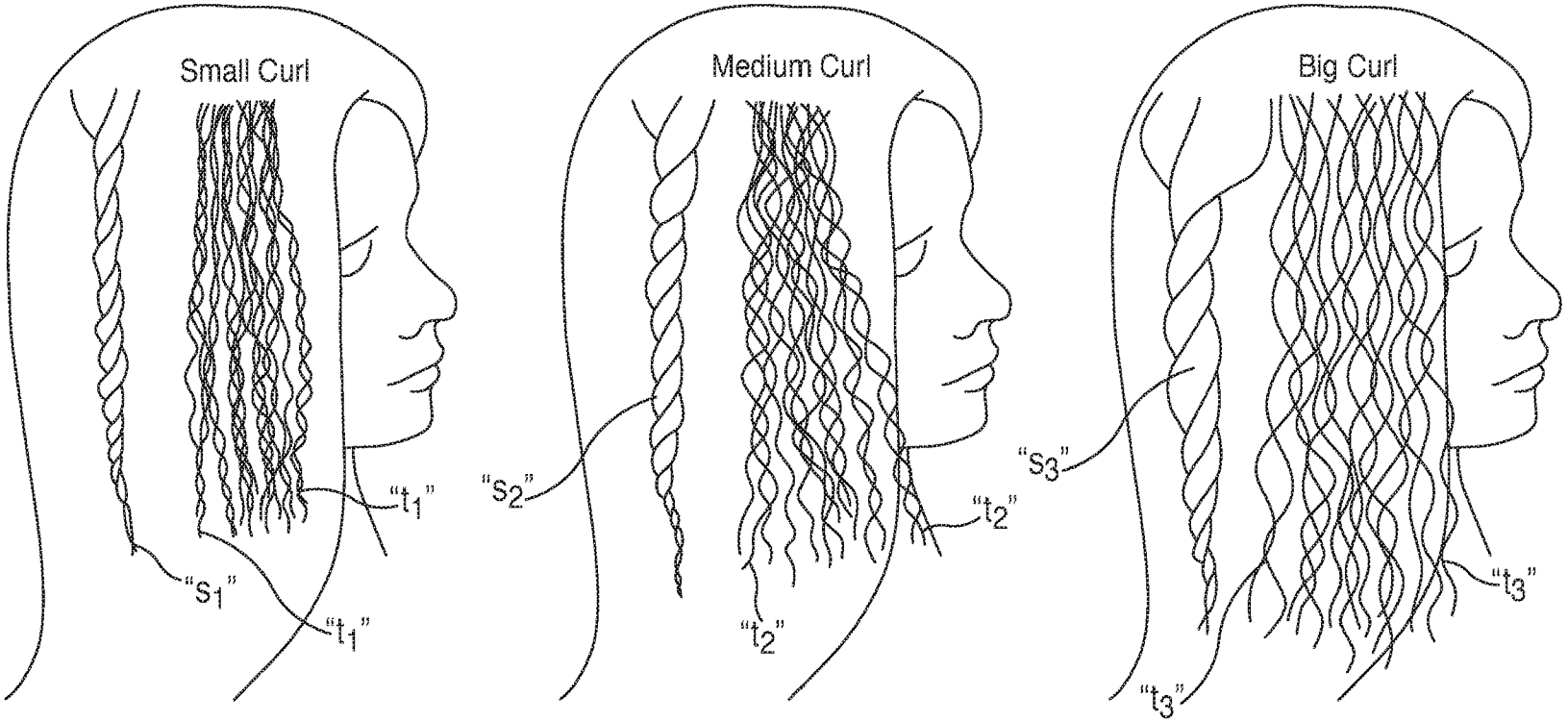
FIGS. 15-17 are views illustrating various wave styles produced by the hair waving apparatus.

FIGS. 15-17 illustrate respective waving of small, medium or large swatches or numbers of hair strands "s1", "s2", "s3". Using the hair waving apparatus 10 as described herein, a small swatch of hair "s1" has relatively fewer individual hair strands and, therefore, a correspondingly smaller diameter when twisted in accordance with the present disclosure. The result is smaller diameter curls and more curls per unit length of hair swatch, as represented by "t1" in FIG. 15. Referring to FIG. 16, a medium diameter swatch s2 has relatively more individual hair strands than a small diameter swatch s1 of like hair, and the resulting curls "t2" are of medium diameter and relatively fewer curls per unit length of hair swatch compared to t1. Finally, as shown in FIG. 17, a large diameter swatch "s3" will result in a curls "t3" with a larger diameter and fewer curls per unit length than "t2" or "t1". As a further feature, each wave may be manually loosened or unfurled by the operator to separate individual curls or twists of hair "t1", "t2", "t3" for each hair wave thereby enhancing the styling effect.

Persons skilled in the art will understand that the devices and methods specifically described herein and illustrated in the accompanying drawings are non-limiting exemplary embodiments. For example, an ion generator may be incorporated in the apparatus 10 to direct a concentration of ions to the length of hair. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described.

What is claimed is:

1. A hair waving apparatus, which comprises:

a handle component defining a longitudinal axis, and proximal and distal ends;

a rotatable component operatively coupled to the handle component and adapted for rotatable movement about the longitudinal axis to engage a length of hair to impart a waving effect to the length of hair, the rotatable component including;

a first treatment member including a first connecting segment and a first treatment head, where a proximal end of the first connecting segment is connected to the distal end of the handle component and an opposing distal end of the first connecting segment is coupled to the first treatment head and the first treatment head extends laterally from the first connecting segment and transverse to the longitudinal axis, a second treatment member including a second connecting segment and a second treatment head, where a proximal end of the second connecting segment is connected to the distal end of the handle component and an opposing distal end of the second connecting segment is coupled to the second treatment head and the second treatment head extends laterally from the second connecting segment and transverse to the longitudinal axis, wherein the first and second treatment members are configured for relative movement between an open condition arranged for reception of a length of hair between the first and second treatment heads and an approximated condition arranged for engaging the length of hair between the first and second treatment heads;

a primary comb mounted to a surface of the first treatment head adjacent the second treatment head such that the primary comb is disposed between the first and second treatment heads, the primary comb extending in transverse relation to the longitudinal axis;

at least one of the first and second treatment members including a heating element; and a drive operatively coupled to the rotatable component to impart rotational movement to the rotatable component to impart the waving effect on the length of hair as the length of hair is pulled across the primary comb when the first and second treatment members are in the approximated condition.

2. The hair waving apparatus according to claim 1 wherein the heating element is mounted to the first treatment member adjacent the primary comb.

3. The hair waving apparatus according to claim 2 wherein the second treatment head of the second treatment member defines a recess for at least partial reception of the primary comb when the first and second treatment members are in the approximated condition.

4. The hair waving apparatus according to claim 2 including an entry comb mounted to the first treatment member proximal of the primary comb.

5. The hair waving apparatus according to claim 4 including an entry comb mounted to the second treatment member whereby at least some of the teeth of the entry combs of the first and second treatment members interdigitate when the first and second treatment members are the approximated condition.

6. The hair waving apparatus according to claim 2 including left and right hair guides depending from the first treatment member on opposed left and right sides of the primary comb, the hair guides dimensioned to capture the hair within the rotatable component when the first and second treatment members are in the approximated condition.

7. The hair waving apparatus according to claim 6 wherein the second treatment member includes left and right recesses for respectively at least partially receiving the left and right hair guides when the first and second treatment members are in the approximated condition.

8. The hair waving apparatus according to claim 2 wherein the rotatable component is configured and adapted for rotational movement in first and second rotational directions relative to the longitudinal axis.

9. The hair waving apparatus according to claim 8 wherein the drive is a motor disposed within the handle component and operatively coupled to the rotatable component.

10. The hair waving apparatus according to claim 9 including a manually operable rotation actuator disposed on the handle component and in electrical communication with the motor, the rotation actuator movable between at least first and second positions corresponding to the first and second rotational directions of the rotatable component.

11. The hair waving apparatus according to claim 2 wherein the first and second treatment members are configured and adapted for pivotal movement between the open condition and the approximated condition.

12. The hair waving apparatus according to claim 1 wherein the first connecting segment of the first treatment head and the second connecting segment of the second treatment head are each arranged about an axis extending at an oblique angle with respect to the longitudinal axis of the handle when the first and second treatment members are in the open condition and in the approximated condition.

13. The hair waving apparatus according to claim 12 wherein the oblique angle of each of the first and second connecting segments is substantially the same.

14. The hair waving apparatus according to claim 13 wherein the oblique angle of each of the first and second connecting segments ranges from between 10 degrees to 60 degrees.

15. The hair waving apparatus according to claim 13 wherein the first and second connecting segments are coupled to respective left sides of the first and second treatment heads with respective right sides of the first and second treatment heads being free from attachment to the first and second connecting segments to thereby define an ingress proximal of the first and second treatment heads configured to permit the length of hair to enter the first and second treatment heads in a direction generally along the longitudinal axis.

16. A hair waving apparatus, which comprises:

a handle component defining a longitudinal axis, and proximal and distal ends;

a rotatable component operatively coupled to the handle component and adapted for rotatable movement about the longitudinal axis to engage a length of hair to impart a waving effect to the length of hair, the rotatable component including:

a first treatment member including a first connecting segment and a first treatment head having opposing right and left sides, where a proximal end of the first connecting segment is connected to the distal end of the handle component and an opposing distal end of the first connecting segment is coupled to the left side of the first treatment head and the first treatment head depends laterally from the first connecting segment and transverse to the longitudinal axis, a second treatment member including a second connecting segment and a second treatment head having opposing right and left sides, where a proximal end of the second connecting segment is connected to the distal end of the handle component and an opposing distal end of the second connecting segment is coupled to the left side of the second treatment head and the second treatment head depends laterally from the second connecting segment and transverse to the longitudinal axis, a primary comb mounted to a surface of the first treatment head adjacent the second treatment head such that the primary comb is disposed between the first and second treatment heads, the primary comb having spaced teeth, and extending in transverse relation to the longitudinal axis;

at least one of the first and second treatment members including a heating element; and a drive operatively coupled to the rotatable component to impart rotational movement to the rotatable component to impart the waving effect on the length of hair as the length of hair is pulled across the primary comb when the first and second treatment members are in the approximated condition.

17. The hair waving apparatus according to claim 16 wherein the right sides of the first and second treatment heads are free from attachment to respective first and second connecting segments to thereby define an ingress proximal of the first and second treatment heads configured to permit the length of hair to enter the first and second treatment heads in a direction generally along the longitudinal axis.

18. The hair waving apparatus according to claim 17 wherein the first connecting segment of the first treatment head and the second connecting segment of the second treatment head are arranged about first and second axes, each of the first and second axes arranged at an oblique angle with respect to the longitudinal axis of the handle when the first and second treatment members are in the open condition and in the approximated condition.

19. The hair waving apparatus according to claim 18 wherein the oblique angle of each of the first and second connecting segments is substantially the same.

20. The hair waving apparatus according to claim 16 wherein the second treatment head of the second treatment member defines a recess for at least partial reception of the primary comb when the first and second treatment members are in the approximated condition.

* * * * *